United States Patent [19]

Matsushita

[11] Patent Number: 4,695,153

[45] Date of Patent: Sep. 22, 1987

[54] DOCTOR BLADE POSITIONING IN ELECTROPHOTOGRAPHIC COPYING MACHINES

[75] Inventor: Mitsuo Matsushita, Higashiosaka, Japan

[73] Assignee: Mita Industrial Co., Ltd., Osaka, Japan

[21] Appl. No.: 823,865

[22] Filed: Jan. 29, 1986

[30] Foreign Application Priority Data

Jan. 30, 1985 [JP] Japan ..... 60-11911[U]

[51] Int. Cl.[4] ..... G03G 15/08; G03G 15/09

[52] U.S. Cl. ..... 355/3 DD; 118/653

[58] Field of Search ..... 355/3 DD, 14 D; 118/653, 656–658, 261

[56] References Cited

U.S. PATENT DOCUMENTS

| | | | |
|---|---|---|---|
| 4,226,524 | 10/1980 | Hashimoto | 118/657 X |
| 4,292,922 | 10/1981 | Yamazaki et al. | 118/657 |
| 4,555,172 | 11/1985 | Mogi | 355/3 DD |
| 4,556,307 | 12/1985 | Jensen | 355/3 DD X |
| 4,585,328 | 4/1986 | Moser et al. | 118/656 X |

FOREIGN PATENT DOCUMENTS

| | | | |
|---|---|---|---|
| 56-4168 | 1/1981 | Japan | 355/3 DD |
| 2105222 | 3/1983 | United Kingdom . | |

*Primary Examiner*—Arthur T. Grimley
*Assistant Examiner*—J. Pendegrass
*Attorney, Agent, or Firm*—Armstrong, Nikaido, Marmelstein & Kubovcik

[57] ABSTRACT

A developing apparatus in electrophotographic copying machines comprising a developing sleeve which maintains developer on its surface and which transports said developer to the region of an electrostatic latent image on a photosensitive body; a doctor blade which regulates the amount of developer on said developing sleeve; a developing housing which contains therein said developing sleeve and said blade and which supports on its side walls both ends of the revolving axis of said developing sleeve; and a supporting section which supports directly or indirectly both ends of said blade at a fixed position on the side walls of said housing at a fixed distance from the surface of said developing sleeve.

5 Claims, 10 Drawing Figures

DOCTOR BLADE POSITIONING IN ELECTROPHOTOGRAPHIC COPYING MACHINES

BACKGROUND OF THE INVENTION

1. Field of the invention

The present invention relates to a developing apparatus in electrophotographic coping machines. More particularly, it relates to a developing apparatus in which a doctor blade faces the surface of a developing sleeve with a given space therebetween.

2. Description of the prior art

In a dry developing method for electrophotography, it is necessary to accurately form a uniform toner layer on an electrostatic latent image on the surface of the photosensitive drum, in order to obtain a satisfactory visible image. One method by which the amount of toner that reaches the surface of the photosensitive drum can be controlled is to establish a fixed distance between the surface of a developing sleeve, which transfers the toner to the surface of the photosensitive drum from the vicinity of the drum, and a doctor blade. This distance must be established with high precision within the limits of approximately $\pm 50\ \mu$. With conventional blades, attachment is by means of adjustment screws, etc., to the side walls of a developer housing. A device such as a thickness gauge is used for both measurement and adjustment of the fixed distance to within the very narrow limits. However, depending upon the pressure with and /or the angle at which this gauge is placed in the space between the sleeve and the blade, the distance is changed, so that a space of varying dimensions (between, for example, the ends of the blade and its center) may result between the blade and the sleeve. Also, individual difference in factors such as skillfulness between one measurer and another may result in differences in this space.

For example, when pieces of dust or similar kinds of foreign matter are mixed into the toner, the foreign matter may form lumps in the space between the sleeve and the blade. The result is that areas upon which the toner does not settle occur in stripes on the sleeve. Therefore, it is necessary to eliminate the foreign matter that has formed lumps in the space by removing the blade at regular intervals. When the space is once again adjusted, then, for the reasons stated above, the reproducibility is poor, which is undesirable.

If the adjustment of the space is not properly done, then a uniform amount of the toner cannot be distributed over the surface of the photosensitive drum, resulting in the final image with irregularities and/or a high fog density.

SUMMARY OF THE INVENTION

The developing apparatus of this invention, which overcomes the above-discussed and numerous other disadvantages and deficiencies of the prior art, comprises a developing sleeve which maintains developer on its surface and which transports said developer to the region of an electrostatic latent image on a photosensitive body; a doctor blade which regulates the amount of developer on said developing sleeve; a developing housing which contains therein said developing sleeve and said blade and which supports on its side walls both ends of the revolving axis of said developing sleeve; and a supporting section which supports directly or indirectly both ends of said blade at a fixed position on the side walls of said housing at a fixed distance from the surface of said developing sleeve.

The supporting section is, in a preferred embodiment, positioned directly on the side walls of said housing.

The supporting section is, in a preferred embodiment, positioned at a pair of spacers to be inserted into the space between said developing sleeve and both side walls of said housing, both ends of said blade being supported by said supporting section of the spacer.

One of the two surfaces that form the edge of the leading surface of said blade is, in a preferred embodiment, on a normal line or in that vicinity with respect to the axis of said sleeve to attain thereby regulation of the amount of developer on said developing sleeve.

The blade forms, in a preferred embodiment, a part of the cover of said housing.

The blade is, in a preferred embodiment, fixed to the supporting section of said housing by resilient means.

Thus, the invention described herein makes possible the objects of (1) providing a developing apparatus which makes possible the establishment of a fixed distance between a doctor blade and a sleeve with a simple operation, without use of a thickness gauge or other such measuring instruments, or such devices as screw, or the like, for the purpose of adjusting the space being required; (2) providing a developing apparatus in which both ends of the blade are directly or indirectly supported in a fixed position at the side walls of the housing of the developing apparatus, and accordingly the blade can be reliably disposed with high precision at a fixed distance from the surface of the developing sleeve, so that the assembly of the developing apparatus can be markedly easier; (3) providing a developing apparatus which is constructed simply and readily, can be assembled with high precision, and in which the distance between the blade and the sleeve does not vary at the reset of the blade, so that the reliability of the image formation is great, and the production cost and maintainance cost of the developing apparatus are both low; and (4) providing a developing apparatus which reliably supplies electrophotography with an excellent image quality since the desired distance between the blade and the sleeve is established and this distance does not change during operation.

BRIEF DESCRIPTION OF THE DRAWINGS

This invention may be better understood and its numerous objects and advantages will become apparent to those skilled in the art by reference to the accompanying drawings as follows:

FIG. 3(*b*) is an enlarged side view of another doctor blade of this invention.

DESCRIPTION OF THE PREFERRED EMBODIMENTS

EXAMPLE 1

Figure 1:
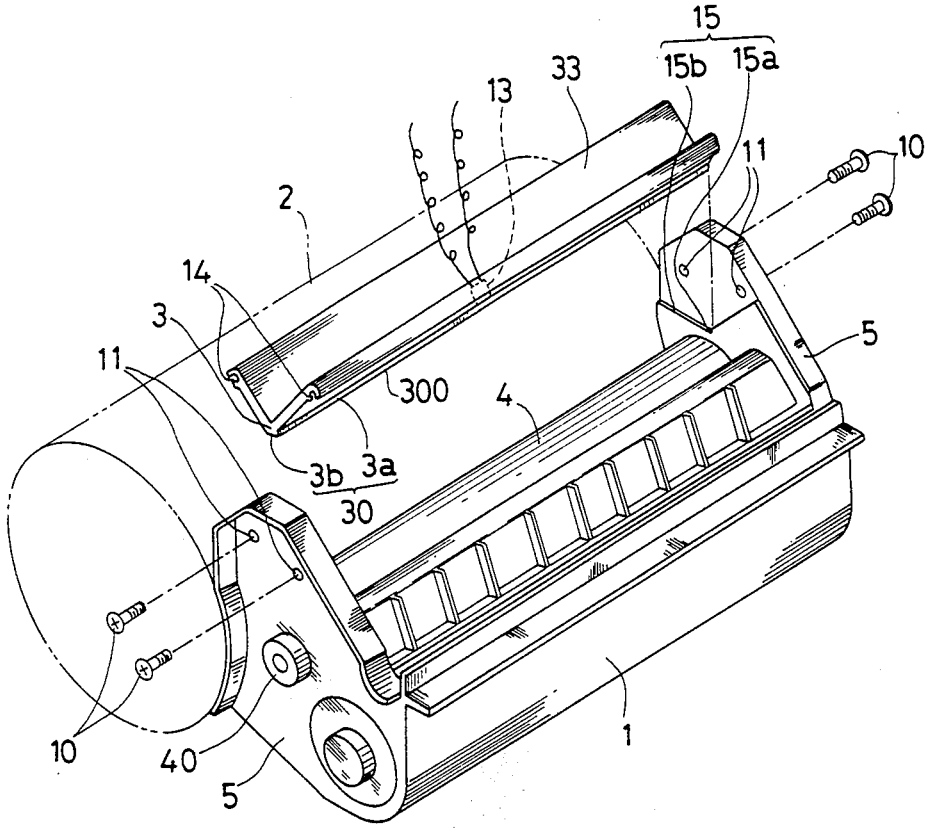
FIG. 1 is a perspective view showing a developing housing and a doctor blade constituting a developing apparatus of this invention.
Figure 2:
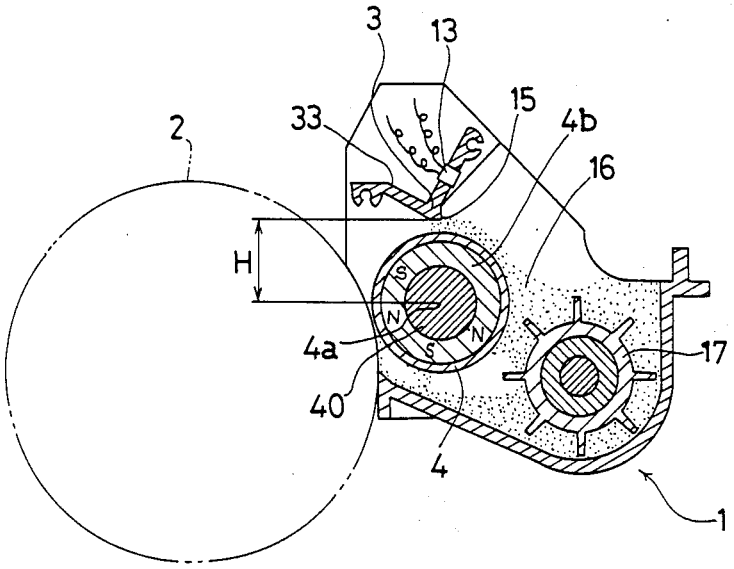
FIG. 2 is a sectional side view showing a developing apparatus of this invention.
Figure 3:
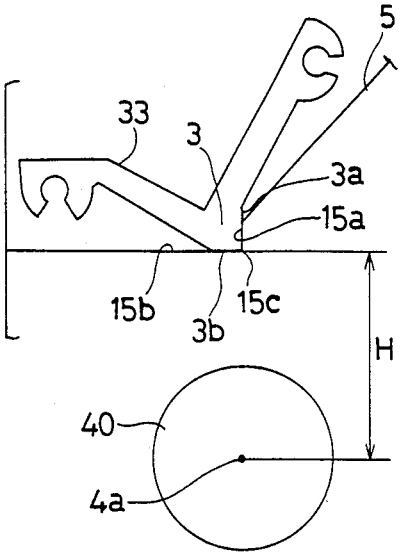
FIG. 3(*a*) is a partly enlarged side view of a doctor blade in the developing apparatus shown in FIG. 2.
Figure 3:
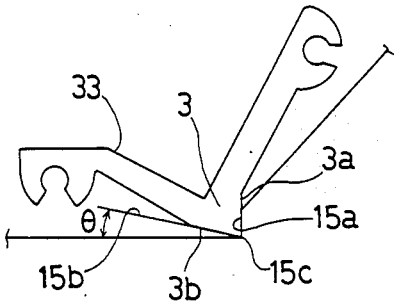

FIGS. 1–3 show a developing apparatus of the present invention, which comprises a developing housing 1 disposed near the photosensitive drum 2, and the developing sleeve 4 disposed within the housing 1, and a doctor blade 3 disposed near the sleeve 4 with a fixed distance from the surface of the sleeve 4. Both ends of the revolving axis 40 of the developing sleeve 4 are supported by the side walls 5 of the housing 1. Within the sleeve 4, a permanent magnet 4*b* is placed. The sleeve 4 and the permanent magnet 4*b* may, for example, be arranged so as to rotate relative to each other. In addition to the sleeve 4, an agitating roller 17 and a single-or two-component developer 16 are within the housing 1. When the developer 16 used is made of a single component, the agitating roller 17 can be omitted. The developer 16 is supplied to the housing 1 from a developer–supply device (not shown) set up outside of the housing 1. The developer 16 is agitated by the roller 17, which causes it to become charged with static electricity because of friction, and then it is supplied to the surface of the sleeve 4. While the developer 16 is formed into a magnetic brush by magnetic lines of the permanent magnet 4*b*, it is drawn toward the surface of the photosensitive drum 2 by the rotation of the sleeve 4.

The blade 3 has the function of regulating the height of the magnetic brush of the developer 16 on the surface of the sleeve 4 by the distance between the leading surface 30 of the blade and the surface of sleeve 4. The height of the magnetic brush of toner is actually controlled by the two surface 3*a* and 3*b* forming the edge 300 extending in the same direction as the axis of the sleeve. A supporting section 15, onto which the control surfaces 3*a* and 3*b* of the blade 3 that regulate the height of the magnetic brush can be directly mounted, is provided on the two side walls 5 of the housing 1. This supporting section 15 must give very precise support to control surfaces 3*a* and 3*b* of the blade 3 that regulates the magnetic brush, and thus supporting surfaces 15*a* and 15*b* are constructed to correspond with these control surfaces 3*a* and 3*b*. The intersection 15*c* of the supporting surface 15*a* and 15*b* is set at a fixed distance H from the center 4*a* of the revolving axis 40 of the sleeve 4. The establishment of this distance H fixes the space between the surface of the sleeve 4 and the intersection 3*c* (i.e., edge 300) of the control surfaces 3*a* and 3*b* of the blade 3.

One of the two control surfaces mentioned above, namely 3*a*, preferably on the normal line with respect to the center 4*a* of the axis of the sleeve 4, or else in that vicinity. The other control surface 3*b* is within a surface at right angles with respect to the normal line, but is not limited thereto. As shown in FIG. 3 (*b*), the surface 3*b* can be at some angle $\theta$ ($90° > \theta \geqq 0°$) to the surface at right angles with respect to the normal line.

The blade 3 constitutes a part of the cover 33 of the developing housing, 1, and after its leading surface 30 is brought up to the supporting section 15 of the side walls 5 of the housing 1, the screw-holes 14 provided in both edges of the blade 3 are attached to the housing side walls 5 by the screws 10 introduced through the screw-holes 11 in the housing side walls 5. This makes possible the fixing onto the housing 1 of the blade 3. At this time, the intersection 3*c* of the control surfaces 3*a* and 3*b* of the blade 3, without any special procedure being necessary, is positioned at a fixed distance H from the surface of the sleeve 4. The procedure of fixing the blade 3 on the housing 1 is not limited to the procedure described here; for example, it is permissible to use the clampboard 112 of FIGS. 4 and 5 to be described below in Example 2.

At a fixed position of the cover 33 of the blade 3 (for example, at the center), a sensor 13 is placed to detect the density of the toner. Because the established position of the blade 3 is always maintained steadily by the supporting sections 15 of the side walls 5 of the housing 1, the position of the sensor 13 inside the housing 1 is also always invariable. Thus, the sensor 13 is able to detect the density of the toner with a high degree of reliability and accuracy.

EXAMPLE 2

Figure 4:
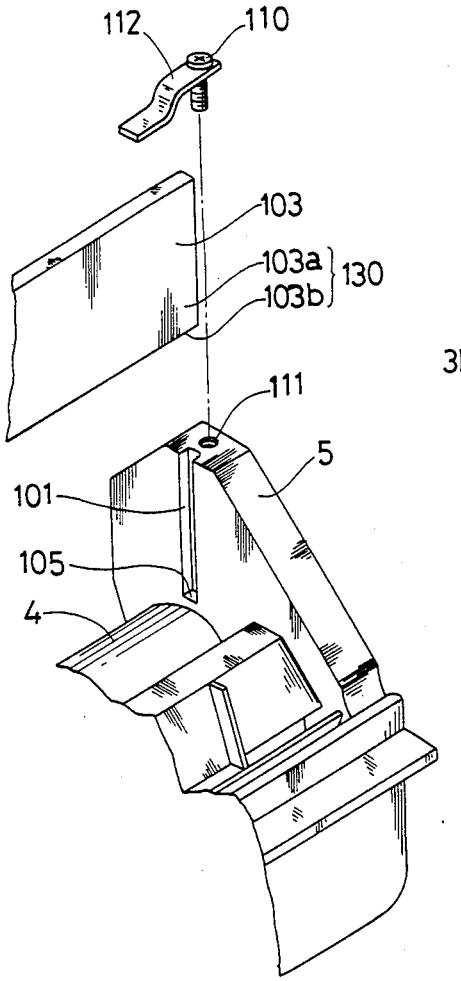
FIG. 4 is a partial perspective view showing a developing housing and a doctor blade constituting another developing apparatus of this invention.
Figure 5:
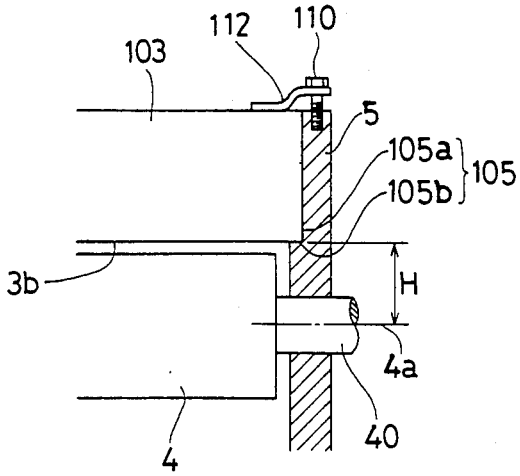
FIG. 5 is a partial sectional front view of the developing apparatus shown in FIG. 4.

FIG. 4 shows another developing apparatus of this invention. There is a groove 101 in the side walls 5 of the developing housing 1, and by merely setting the doctor blade 103 into this groove 101, then, as in Example 1, the control surface 103*b* of the blade 103 regulating the magnetic brush is established at afixed distance H (FIG. 5) from the center 4*a* of the axis of the sleeve 4. As a result, the leading edge 130 of the blade 103 is set correspondingly at a fixed distance from the surface of the sleeve 4.

The blade 103, after it is placed in this way into the grooves 101 of the side walls 5 of the housing 1, is preferably fixed by means of clampboards 112, constructed so as to have resiliency by use of a spring or the like, to the side walls 5 of the housing 1 by screws 110 placed through the holes 111 in the side walls. Thus, the blade 103 can be maintained at a fixed distance from the sleeve 4 even while the developing apparatus is in operation.

Of course, the blade 103 can, as in Example 1, be made so as to form the part of a cover for the developing housing 1. Also, the lower part of the groove 101 in the side walls 5 of the housing 1 form the blade-supporting areas 105, as in Example 1. The blade-supporting areas 105, comprise supporting surfaces 105*a* and 105*b* corresponding to the magneticbrush control surfaces 130*a* and 103*b* of the blade 103. The control surface 103*a* is preferably on a normal line or nearly so with respect to the axis of the sleeve 4. The other surface 103*b* is, as in Example 1, at some angle $\theta$ ($90° > \theta \geqq 0°$) to the surface at right angles with respect to the normal line of the center 4*a* of the sleeve axis 40.

EXAMPLE 3

Figure 6:
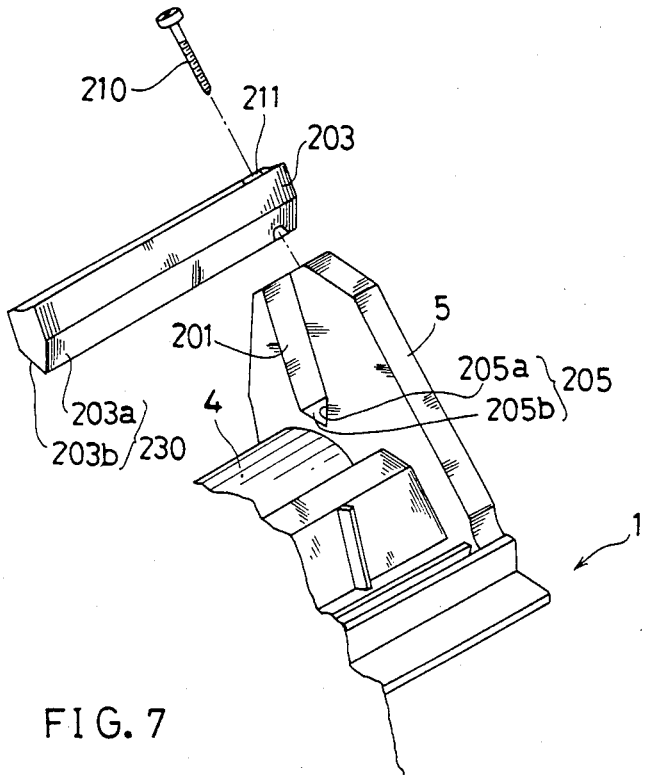
FIG. 6 is a partial perspective view showing a developing housing and a doctor blade constituting another developing apparatus of this invention.

Another developing apparatus of the present invention is shown in FIG. 6.

In the side walls 5 of the developing housing 1, as in Example 2, there are grooves 201, into which the doctor blade 203 is inserted. The lower part of each of the grooves 201 form a supporting section 205 which supports the leading edge 230 of the blade 203. This supporting section 205 comprises supporting surfaces 203*a* and 205*b* corresponding to control surfaces 203*a* and 203*b*, which control the height of the magnetic brush and which form the leading-edge surfaces 230 of the blade 203. The surfaces 205*a* and 205*b* meet in a V-shape.

One of the control surfaces, 203*a*, is , as in the above-mentioned Examples 1 and 2, in a normal line with respect to the center 4*a* of the sleeve 4, or else in that vicinity. The other control surface 203*b* is within a surface at right angles with respect to the normal line, but is not limited thereto. The surface 203*b* can be, as in Examples 1 and 2, at some angle $\theta$ ($90° > \theta \geqq 0°$) to the surface at right angles with respect to the normal line.

Figure 7:
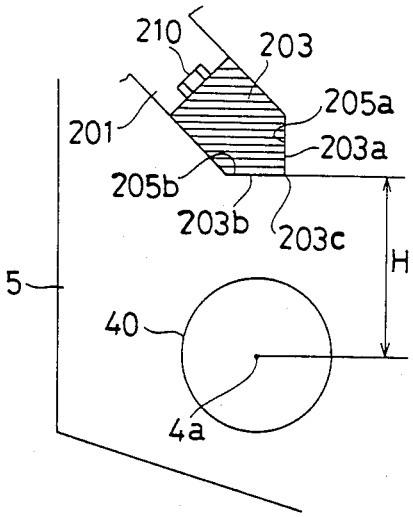
FIG. 7 is a partial sectional side view of the developing apparatus of this invention.

When the blade 203 is inserted into the grooves 201, the control surfaces 203*a* and 203*b* of this blade 203 are in precise correspondence with supporting surfaces 205*a* and 205*b*, respectively. This means that, as shown in FIG. 7, the intersection 203*c* of the control surfaces 203*a* and 203*b* of the blade 203 if established at the side walls 5 of the housing 1 at a fixed distance H from the center 4*a* of the axis of developing sleeve 4. The result is that the intersection 203*c* of the control surfaces 203*a* and 203*b* of blade 203 can, as in the above examples. be kept at a fixed distance from the surface of the sleeve 4 without any special procedures being necessary.

By the insertion of a screw 210, through the hole 211 in each of both ends of the blade 203, into a hole (not shown) in the lower part 205 of the groove 201, this blade 203 is fixed onto the housing side walls 5. In this step of fixing, the construction of Example 2, in which the clampboard 112 is used, may also be employed. Also, this blade 203 can, as in Example 1, be used as a part of the lid of developing housing 1.

EXAMPLE 4

Figure 8:
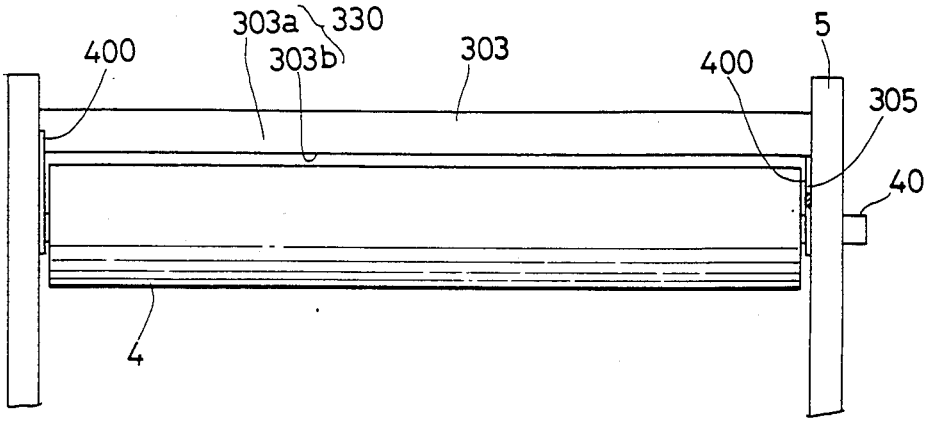
FIG. 8 is a partial front view showing another developing apparatus of this invention.
Figure 9:
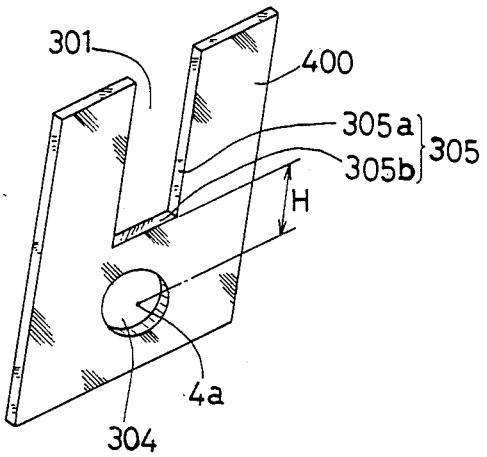
FIG. 9 is a perspective view showing a spacer used in the developing apparatus shown in FIG. 8.

FIG. 8 shows another developing apparatus of this invention. A doctor blade 303 is supported on the side walls 5 of developing housing 1 by a pair of metal spacer 400. In the spacers 400, as shown in FIG. 9, a groove 301 has been cut out. The lower part of this groove 301 constitutes a supporting section 305, which supports the blade 303 thereon. This supporting section 305, as in the above examples, corresponds to the control surfaces 303*a* and 303*b*, which regulate the magnetic brush and which together form the leading surface 330 of the blade 303. The supporting section 305 consists of supporting surfaces 305*a* and 305*b*. In the spacer 400, there is also a hole 304 that receives the axis 40 of the sleeve 4. one of these surfaces, 305*b*, is at a fixed distance H from the center of the hole 304.

The sleeve 4 is fixed to housing side walls 5 by the passage of both ends of the revolving axis 40 through holes 304 in each spacer 400, and by this means, the spacers 400 are fixed to the housing side walls 5 with the distance H between the intersection 305*c* of the supporting surfaces 305*a* and 305*b* of the spacer 400 and the center 4*a* of the axis of the sleeve 4. The result is that when both ends of the blade 303 are inserted into the groove 301 of the spacer 400, the intersection 303*c* of the control surfaces 303*a* and 303*b* of the blade 303, which control the height of the magnetic brush, is set so as to face the surface of the sleeve 4 at a fixed distance.

In this way, the distance H between the intersection 305*c* of the supporting surfaces 305*a* and 305*b* of the spacer 400 and the center 4*a* of the axis of the sleeve 4 is dependent only upon the precision of the manufacturing of the supporting section 305 and the hole 304 in the spacer 400, and the distance is unaffected by the manufacturing precision of other places such as the housing side walls 5, etc., which means that the accumulated error during construction can be kept very small indeed. For that reason, the distance H can be established easily to a high degree of accuracy. Moreover, a metal, the measurements of which do not readily change in response to changes in the environment, can be used for the spacer 400, so that the high level of measurement precision of this spacer can be maintained. Both use and construction of this spacer are easy.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty which reside in the present invention, including all features which would be treated as equivalents thereof by those skilled in the art to which this invention pertains.

What is claimed is:

1. In a developing apparatus of an electrophotographic copying machine which comprises a developing housing having side walls which support a developing sleeve having a cylindrical surface for transporting a developer and a doctor blade which regulates the amnount of developer transported by said developing sleeve, a supporting means for supporting and positioning said doctor blade with respect to said developing sleeve comprising:

means arranged at said housing side walls for rotatably supporting said developing sleeve at ends thereof for rotation about an axis of said cylindrical surface;

said doctor blade having a leading surface edge formed thereon by a pair of control surfaces including a first planar control surface parallel to said axis and lying on a normal line with respect to said developing sleeve axis and a second planar control surface lying in a plane parallel to said axis and intersecting said first planar surface at an angle $\theta$ such that $90° > \theta > 0°$, the intersection of said planar surfaces forming a leading surface edge extending in the same direction as said axis of said sleeve; and a supporting means for supporting said doctor blade at said control surfaces comprising a pair of supporting sections formed, respectively, at each of said housing side walls, said supporting sections each comprising a first planar supporting surface parallel to said first control surface and a second planar supporting surface parallel to said second control surface, and means for hold said doctor blade control surfaces firmly against said supporting section supporting surfaces such that said leading surface edge is supported at a fixed distance from said cylindrical surface of said developing sleeve to regulate the amount of developer transported thereby.

2. An apparatus according to claim 1, wherein said supporting sections are formed directly on the side walls of said housing.

3. An apparatus according to claim 1, wherein said supporting sections are formed as a pair of spacers inserted into spaces between said developing sleeve and both side walls of said housing, ends of said doctor blade being supported by a respective one of said supporting sections.

4. An apparatus according to claim 1, wherein said doctor blade forms a part of a cover of said housing.

5. An apparatus according to claim 1, wherein said blade is fixed to the supporting section of said housing by resilient means.

* * * * *